United States Patent [19]
Norman et al.
[11] 4,452,259
[45] Jun. 5, 1984

[54] SMOKING ARTICLES HAVING A REDUCED FREE BURN TIME

[75] Inventors: Vello Norman, Raleigh; Arthur M. Ihrig, Greensboro, both of N.C.

[73] Assignee: Loews Theatres, Inc., New York, N.Y.

[21] Appl. No.: 282,052

[22] Filed: Jul. 10, 1981

[51] Int. Cl.[3] ..... A234D 1/02; A24D 1/16
[52] U.S. Cl. ..... 131/349; 131/256; 131/365
[58] Field of Search ..... 131/349, 256, 365, 358

[56] References Cited

U.S. PATENT DOCUMENTS

| | | | |
|---|---|---|---|
| 1,555,320 | 9/1925 | Weil | 131/349 |
| 1,581,451 | 4/1926 | Knapp | 131/349 |
| 1,605,059 | 11/1926 | Oakes et al. | 131/349 |
| 1,744,615 | 1/1930 | Crosthwait | 131/349 |
| 1,972,718 | 6/1934 | Sharlit | 131/349 |
| 1,996,002 | 4/1935 | Seaman | 131/349 |
| 1,999,222 | 5/1935 | Weinberger | 131/349 |
| 2,013,508 | 6/1937 | Seaman | 131/349 |
| 2,049,320 | 7/1936 | Ruben et al. | |
| 2,098,619 | 3/1938 | Finnell | |
| 2,108,860 | 4/1938 | Kauffman | |
| 2,114,281 | 7/1938 | Allen | |
| 2,307,088 | 11/1942 | Whiteley | |
| 2,327,991 | 6/1943 | Betts | 131/349 |
| 2,329,927 | 9/1934 | Morton | 131/349 |
| 2,335,432 | 11/1943 | Millett | 131/349 |
| 2,349,551 | 3/1944 | Helm | 131/349 |
| 2,580,608 | 7/1946 | Schur et al. | 131/349 |
| 2,580,610 | 7/1946 | Schur et al. | 131/349 |
| 2,580,611 | 7/1946 | Schur et al. | 131/349 |
| 2,666,437 | 12/1953 | Lottof | 131/349 |
| 2,718,889 | 8/1954 | Claussen | 131/349 |
| 2,746,890 | 11/1954 | Legler | 131/349 |
| 2,754,828 | 2/1955 | Swain | 131/349 |
| 2,755,206 | 3/1955 | Statia, Sr. | 131/349 |
| 2,766,148 | 4/1955 | Rowland | 131/349 |
| 2,786,471 | 6/1955 | Graybeal | 131/349 |
| 2,839,065 | 11/1955 | Milton | 131/349 |
| 2,886,041 | 3/1956 | Harwood | 131/349 |

(List continued on next page.)

FOREIGN PATENT DOCUMENTS

| | | |
|---|---|---|
| 149216 | 6/1954 | Australia . |
| 1068992 | 6/1969 | Fed. Rep. of Germany . |
| 2110216 | 8/1978 | Fed. Rep. of Germany . |
| 1590223 | 7/1972 | France . |
| 421236 | 4/1932 | United Kingdom . |
| 1056941 | 6/1959 | United Kingdom . |

OTHER PUBLICATIONS

Industrial & Eng. Chem., 21, 853, 1929.

*Primary Examiner*—V. Millin
*Attorney, Agent, or Firm*—Brumbaugh, Graves, Donohue & Raymond

[57] ABSTRACT

This invention relates to smoking articles having reduced free burn time, including cigarettes, cigars and little cigars. The smoking article comprises tobacco wrapped in a paper having at least one circumferential band printed between the ends of the smoking article; preferably at about the center of the smoking article. The band contains a substance which will cause the smoking article to extinguish in about 2–5 minutes under free burn conditions after the cone reaches the banded area if it is not puffed. The band is typically about 2–10 mm wide containing a substance which is a liquid in the temperature range of about 100° C. to 200° C. and which as the burning cone comes in contact with it provides a fluid film on the paper, without substantially penetrating through the surface of the paper, which film is substantially impervious to air and decomposes and/or distills endothermically from about 140° C. to 300° C. to yield gaseous decomposition products normally present in the smoke of smoking articles without the band. The amount of the substance used in the band should be sufficient to extinguish the smoking articles under free burn conditions within 2–5 minutes.

13 Claims, No Drawings

U.S. PATENT DOCUMENTS

| | | | |
|---|---|---|---|
| 2,890,704 | 5/1956 | Lamm | 131/349 |
| 2,914,072 | 7/1956 | Tyrer | 131/349 |
| 2,976,190 | 8/1957 | Meyer | 131/349 |
| 2,988,088 | 9/1957 | Schur | 131/349 |
| 2,996,065 | 11/1960 | North | 131/349 |
| 2,998,012 | 11/1960 | Lamm | 131/349 |
| 2,998,819 | 12/1960 | Snowden, Jr. | 131/349 |
| 3,006,347 | 11/1962 | Keaton | 131/349 |
| 3,030,963 | 4/1962 | Cohn | 131/349 |
| 3,034,932 | 4/1962 | Donovan et al. | 131/349 |
| 3,046,994 | 5/1962 | Schur | 131/349 |
| 3,064,657 | 8/1962 | Shriner | 131/349 |
| 3,081,776 | 11/1962 | Park | 131/349 |
| 3,091,243 | 1/1963 | Guida | 131/349 |
| 3,102,543 | 5/1963 | O'Siel et al. | 131/349 |
| 3,165,105 | 7/1963 | Campbell | 131/349 |
| 3,183,914 | 8/1964 | Cohn | 131/349 |
| 3,220,418 | 12/1964 | Cohn | 131/349 |
| 3,244,183 | 4/1965 | Pym | 131/349 |
| 3,276,453 | 7/1965 | Corley | 131/349 |
| 3,288,145 | 11/1966 | Rosenthal | 131/349 |
| 3,303,849 | 9/1967 | Arnold, Jr. et al. | 131/349 |
| 3,313,305 | 10/1967 | Noznick et al. | 131/349 |
| 3,318,314 | 11/1967 | Stelzer | 131/349 |
| 3,324,861 | 1/1960 | Gaisman | 131/349 |
| 3,370,593 | 3/1968 | Owaki | 131/349 |
| 3,392,735 | 4/1968 | Lebert | 131/349 |
| 3,488,725 | 4/1969 | Sherr et al. | 131/349 |
| 3,503,406 | 9/1969 | Riegel et al. | 131/349 |
| 3,526,904 | 6/1970 | Tamol | 131/349 |
| 3,528,432 | 7/1970 | Stossel | 131/349 |
| 3,547,131 | 9/1970 | Dock | 131/349 |
| 3,581,748 | 1/1971 | Cameron | 131/349 |
| 3,590,825 | 3/1971 | Davis | 131/349 |
| 3,602,232 | 12/1971 | Grauvogel et al. | 131/349 |
| 3,632,384 | 8/1972 | Saint-Pastou | 131/349 |
| 3,664,350 | 9/1972 | Wall | 131/349 |
| 3,667,479 | 1/1973 | Sanford et al. | 131/349 |
| 3,702,117 | 11/1973 | Borthwick | 131/349 |
| 3,736,940 | 7/1974 | Saint-Pastou | 131/349 |
| 3,800,805 | 1/1975 | Horsewell et al. | 131/349 |
| 3,805,799 | 11/1975 | Stewart, Jr. et al. | 131/349 |
| 3,821,958 | 7/1976 | Overleese | 131/349 |
| 3,878,850 | 1/1977 | Gibson et al. | 131/349 |
| 3,884,246 | 2/1977 | Walker | 131/349 |
| 3,886,954 | 3/1977 | Hannema et al. | 131/349 |
| 3,903,899 | 3/1977 | Musillo | 131/349 |
| 3,911,932 | 5/1977 | Houck, Jr. et al. | 131/349 |
| 3,916,914 | 6/1977 | Brooks et al. | 131/349 |
| 3,977,416 | 6/1977 | Akiba | 131/349 |
| 3,985,143 | 6/1977 | Lappin, Jr. | 131/349 |
| 4,006,749 | 7/1977 | Horowitz et al. | 131/349 |
| 4,027,680 | 7/1977 | De Marco | 131/349 |
| 4,044,778 | 8/1977 | Cohn | 131/349 |
| 4,061,147 | 11/1977 | Falchi | 131/349 |
| 4,077,414 | 1/1978 | Baker et al. | 131/349 |
| 4,091,821 | 2/1978 | Scorzo | 131/349 |
| 4,146,040 | 7/1979 | Cohn | 131/349 |
| 4,187,862 | 9/1979 | Cohn | 131/349 |
| 4,303,084 | 12/1981 | Simon | 131/349 |

SMOKING ARTICLES HAVING A REDUCED FREE BURN TIME

BACKGROUND OF THE INVENTION

This invention relates to smoking articles having reduced free burn time including cigarettes, cigars and little cigars, herein generally referred to as cigarettes. By "free burn time" we are referring to the time it will take a cigarette to extinguish itself in the open air, free from contact between the burning cigarette and other surfaces while it is not being puffed. In a conventional cigarette this time could be the time required for a cigarette to burn from the point when it is first lighted until the point when substantially all of the tobacco has been consumed. In accordance with the present invention, the free burn time of a cigarette is reduced by the addition of one or more bands along the length of the cigarette which, unless the cigarette is being puffed on, causes the burning cigarette to extinguish before all of the tobacco is consumed. The material used in the bands has not heretofore been suggested for this purpose and is fully described herein.

For many years attempts have been made to design a cigarette with a reduced free burn time. Unfortunately none of these attempts have resulted in a cigarette having a reduced free burn time which would be acceptable to the consumer. In the past, attempts to develop a cigarette having a reduced free burn time have involved experimenting with one or more of the factors which affect a cigarette's rate of burning. U.S. Pat. Nos. 1,996,002; 2,013,508 and 1,999,222 describe cigarettes of decreased inflammability which will go out when not being puffed. The cigarettes do not extinguish themselves when being actively puffed. The bands described in U.S. Pat. No. 1,996,002 are from 0.25–0.75 inches in width and contain materials such as ammonium sulfate, ammonium chloride, ammonium phosphate, boric acid, sodium silicate, cellulose organic esters, cellulose ethers, natural resins, oleo-resins, synthetic resins, and phenolaldehyde resins.

U.S. Pat. No. 2,013,508 discloses the concept of applying a fire retardant material in a 0.25 to 0.75 inch band-like pattern to either the finished cigarette or to the paper used in forming the cigarette. The fire retardant employed is a cellulosic composition containing barium sulphide which is immersed in a film of zinc sulphide solution and attached to the cigarette with an agglutinating substance.

U.S. Pat. No. 1,999,222 discloses a plurality of strips of paper which are secured to the inner surface of the cigarette paper and coated with a suitable agglutinating substance. These strips are about one-sixteenth inch wide and the bands function to exclude the oxygen from the inner surface of the cigarette envelope so that the cigarette extinguishes if not being puffed on when the burning cone is in the banded region.

A different approach is described in U.S. Pat. Nos. 4,044,778 and 4,187,862 wherein the wrapper which encloses the tobacco is coated with material deposited from an aqueous solution of an alkali metal silicate.

Other researchers have also described cigarette papers chemically treated to reduce the free burn time of the cigarette. Another suggested method of making cigarettes having a reduced free burn time was to incorporate fire resistant bands or rings into the cigarette itself which when reached would cause the cigarette to go out, even when being actively puffed. Chemicals have also been introduced into the tobacco to reduce the rate of burning. These attempts to create a cigarette with a reduced free burn time have introduced toxic substances, increased smoke yields or resulted in perceptible changes in the flavor impression of the cigarette or produced a cigarette which would extinguish while it is being smoked. In the past none of these efforts have been successful in producing a cigarette having a reduced free burn time, which would be acceptable to the average smoker.

When compounds are added, either to the tobacco or to the cigarette paper, it is likely that some fraction of the added material, its thermal decomposition products, or the reactants of its thermal decomposition products and tobacco moieties will enter the smokestream and be inhaled by the smoker. The prior art on cigarettes having reduced free burn times contains references to such materials as halogenated compounds, antimony trioxide, urea, diethanolamine, melamine, organophosphorous compounds, and the like, as materials for imparting flame resistance. The toxicity of some of these materials has been demonstrated. In addition the toxicity for many other suggested compounds is unknown. An added problem is posed by the fact that many of the solutions suggested by the prior art would decrease the efficiency of the tobacco burning process which is also undesirable.

In addition to the aforesaid considerations, there are important consumer preference problems which must be considered. Smokers expect that a cigarette will burn at a uniform rate. If the rate of burning slows and the cigarette extinguishes itself during normal use, the consumer is likely to conclude that the product is somehow defective, particularly because relighting a cigarette produces a highly undesirable taste. Similarly, in the past it has been found that modifications in the cigarette which reduce free burn time perceptibly alter the taste of the cigarette or increase the smoke yield or tar yield. Such characteristics would not be preferred by today's consumers.

SUMMARY OF THE INVENTION

An improved smoking article having a reduced free burn time has now been found which overcomes many of the problems of the smoking articles described in the prior art, particularly cigarettes, having reduced free burn time.

The smoking article having a reduced free burn time comprises tobacco wrapped in a paper having at least one circumferential band printed between the ends of the smoking article; preferably at about the center of the smoking article. The band contains a substance which will cause the burning cone of the smoking article to extinguish in within 2–5 minutes (measured under free burn conditions) after the cone reaches the band if the article is not puffed.* The band is typically about 2–10 mm wide containing a substance which is a liquid in the temperature range of about 100° C. to 200° C. and which, as the burning cone comes in contact with it, provides a fluid film on the paper, without substantially penetrating into the paper, which film substantially restricts the flow of air to the burning cone and distills and/or decomposes endothermically from about 140° C. to 300° C. the gaseous decomposition or vaporization products of the compound being normally present in the smoke of smoking articles without the band. The amount of the substance used in the band should be sufficient to extinguish the smoking article under free burn conditions within 2–5 minutes after the burning cone reaches the band.

* Free burn conditions refer to burning of the cigarette in open air, but without puffing, and free from contact between the burning cigarette and other surfaces. It will be understood that, unless otherwise stated, all future references to the effect of the banded zone—i.e.: extinguishing the smoking article in 2–5 minutes—refer to such time measured from the time when the burning cone reaches the band. The total free burn time of the smoking article will include the additional time required from the last puff until the burning cone reaches the banded zone.

The band when applied to a cigarette causes the cigarette to extinguish in 2–5 minutes after the cone reaches the band, if the cigarette is not puffed. A shorter extinguishing time would be annoying to most smokers. The band will not interfere with the normal smoking of the cigarette if the cigarette is puffed every one to two minutes, as is typical of cigarette smokers. Because the compound or compounds used in the band are selected to yield gaseous combustion products normally found in cigarette smoke, the bands should neither substantially affect the smoke yields to the smoker nor the normal organoleptic characteristics of the smoke.

Substances or compounds useful in cigarettes having a reduced free burn time should be liquid in the temperature range of about 100° C. to 200° C. which as the burning cone comes in contact with them, form a film on the cigarette paper without substantially penetrating into the paper, which film substantially restricts the flow of air to the burning cone and which distills or decomposes endothermically from about 140° C. to 300° C., the decomposition or vaporization products of which are gases normally present in the smoke of untreated cigarettes. Some examples of compounds which will provide a cigarette with a reduced free burn time, are lactic acid; galacturonic acid; ammonium salts of galacturonic acid; polybasic organic acids having about 3–6 carbon atoms; the partial alkali metal, ammonium and alkaline earth metal salts of polybasic organic acids having about 3–6 carbon atoms; polybasic hydroxy organic acids having about 3–6 carbon atoms; the partial alkali metal, alkaline earth metal and ammonium salts of polybasic hydroxy organic acid having about 3–6 carbon atoms; acrylic acid polymers; polyvinylacetate; cellulose acetate; silicone polymers having the general formula:

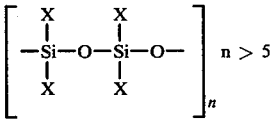

$$\left[ -\underset{X}{\overset{X}{Si}}-O-\underset{X}{\overset{X}{Si}}-O- \right]_n \quad n > 5$$

wherein X can be hydrogen, or an alkyl group having 1–6 carbon atoms or a substituted aromatic group and copolymers of maleic anhydride and vinyl radicals having the formula

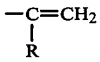

$$-\underset{R}{C}=CH_2$$

wherein R is hydrogen, an alkyl group having 1–6 carbon atoms or an aromatic or substituted aromatic group. These compounds which are not normally considered to be flame retarding materials, can be used alone or in combination to produce a cigarette having a reduced free burn time.

The polybasic organic acids, polybasic hydroxy organic acids and their partial salts are particularly useful and preferred for use in cigarettes having a reduced burn time, since they are normally present in tobacco or are structurally related to naturally occurring tobacco compounds and generally decompose to $CO_2$, CO and simple organic molecules normally present in tobacco smoke.

The silicone polymers are relatively nonflammable as indicated by spontaneous ignition temperatures in excess of 475° C. The gaseous and vaporous combustion products from the polymers are also believed to be normally present in tobacco smoke.

The cigarette having a reduced free burn time is made by conventional cigarette manufacturing techniques and any conventional blend of tobacco and tobacco flavoring additives can be used. The bands are printed on the cigarette paper by procedures known in cigarette manufacturing and generally involve the use of a soft impression roller or rollers of a desired configuration. A pick-up roller rotating in a solution of the compound to be applied to the cigarette serves to transfer the liquid to the impression roller for the printing step. Similarly, the bands can be printed by the conventional techniques of gravure printing.

In most cases the substance to be printed on the cigarette paper is dissolved or dispersed in an appropriate solvent prior to printing. Any rapid drying solvent can be used for this purpose, for example, water, ethanol or acetone.

The band can be printed on the inside or outside of the cigarette paper before the cigarette is manufactured. The liquid can also be applied to the cigarette paper as a narrow band around the outside circumference of a finished cigarette.

It is believed that the effective amount of the substance in the band and the width of the band depend on the viscosity of the compound at 100° C. to 200° C., and its molecular weight. The compound should provide a film when it contacts the burning cone but the film should not substantially penetrate the surface of the paper. The amount of the compound and the width of the band must be sufficient in order that normal puffing on the cigarette will burn through the band. However, if the cigarette is not being puffed, the amount of the compound deposited and the width of the band must be sufficient to cause the cigarette to go out in about 2–5 minutes after the cone reaches the band if it is not puffed again. The amount of compound required in the band is usually in the range of about 0.8 mg to 5 mg per band.

The band can be about 2 mm to 10 mm wide and preferably about 3–7 mm. The band width is kept narrow in order to minimize interference with the porosity of the cigarette paper which affects the yields of the various smoke components. The burning cigarette cone can be typically about 5 mm deep. A band of about 2 mm is the minimum needed to effectively reduce the free burn time of the cigarette. It is possible that a somewhat narrower band could be used on cigarettes with cones smaller than 5 mm and by applying higher amounts of the compounds.

It is likely that for most filter cigarettes one band about 2–10 mm wide located about halfway down the cigarette will be sufficient to extinguish a standard cigarette. A single band at that location on the filter cigarette cuts the free burn time in half. If the cigarette is not puffed on after it is lit, it will free burn up to the band and extinguish itself. If the filter cigarette is not puffed on after smoking has proceeded past the band, it can only burn to the filter tip and then go out.

On nonfilter cigarettes it may be preferable to apply a second band about 20–25 mm from the smoking tip to insure that the free burn time will be reduced and the cigarette extinguished prior to complete consumption of the cigarette.

Although additional bands can be applied to the cigarette, in normal circumstances only one band about halfway down a filter cigarette is used. As described above, it may be preferable for nonfilter cigarettes to have two bands. Additional bands are not preferred since they may begin to significantly interfere with cigarette paper porosity and affect smoke yields and tar yields.

Since some consumers may be offended by the visual appearance of a band on the cigarette, it can be printed on the inside of the cigarette paper prior to being applied to the tobacco column. It has also been found that the band can be made less obvious by mixing whitening agents normally used in cigarette paper such as titanium dioxide and calcium carbonate with the solution prior to printing on the paper.

We believe that the mechanism involved in reducing free burn time is due to the fact that the compounds in the band interact both physically and chemically with the burning cigarette cone to absorb heat from the burning cone and to reduce the accessibility of the cone to the influx of oxygen. It appears from photomicrographs that the advancing cone melts the compound in the band (if it is not already a liquid) and forms a film on the surface of the paper without substantially penetrating into it. The film appears to clog the pores of the cigarette paper which substantially restricts the flow of air to the burning cone. As the hottest part of the cone approaches the band, the compound distills or decomposes (or both) endothermically and thereby serves as an energy sink. This action reduces the amount of energy available for the propagation of tobacco combustion and thereby extinguishes the burning cone and reduces the free burn time of the cigarette.

If a puff is taken on the cigarette within 1–2 minutes after the leading edge of the cone reaches the band, the additional heat generated by the puffing causes the substance in the band to decompose more quickly, thereby destroying the film formed by the substance in the band. The cigarette will then continue to burn normally.

The invention can be further illustrated by the following examples. These examples are not meant to limit the invention but are included only as a means of further demonstrating how the smoking articles, particularly cigarettes having a reduced free burn time, are prepared and tested. Although this invention is preferably used on cigarettes, it is equally applicable to other smoking articles, including cigars and little cigars. The substances selected for use in these examples, based on available information, are believed to be nontoxic.

EXAMPLE 1

A solution was prepared by dissolving 3 grams of malic acid in 10 ml of water at room temperature and using a calibrated micro syringe, 6 μl of the solution were applied to the side of the cigarette in the form of a 7 mm band about halfway down a standard 85 mm filter cigarette. The band completely encircled the cigarette. The band was allowed to dry. The process was repeated for a second cigarette.

The cigarettes were then tested to determine if the cigarettes would cease to burn when the burning cone reached the banded region. The smoking tests were conducted using a two port smoking machine with the cigarettes held by a Cambridge filter pad holder. Two cigarettes were lit and smoked in a horizontal position using a puffing regime of 2 second, 35 ml puffs taken once a minute. The two cigarettes were smoked using this regime to within about 5 mm of the treated band. The cigarettes were then allowed to burn under free burn conditions. The time for each cigarette was recorded from when the burning edge of the cone reached the band until the cigarette extinguished (herein referred to as extinguishing time). Typical results from this test and all succeeding tests appear in Table 1.

EXAMPLE 2

Three cigarettes were prepared and tested as described in Example 1, except that the compound was dissolved in 10 ml of ethanol.

EXAMPLE 3

Two cigarettes were prepared and tested as described in Example 1, except that the 7 mm band was printed on the inside of the cigarette paper prior to being wrapped around the tobacco.

EXAMPLE 4

Three cigarettes were prepared and tested as described in Example 1, except that the solution contained 5 grams of malic acid and 10 ml of ethanol. 5 μl of the solution was printed as a 3 mm band. Two of the cigarettes self-extinguished and one burned through.

EXAMPLE 5

Two cigarettes were prepared and tested as described in Example 1, except that citric acid was used.

EXAMPLE 6

Two cigarettes were prepared and tested as described in Example 1, except that 6 μl of a solution containing 1.99 mg of the monosodium salt of citric acid ($NaH_2$ citrate) in water was used.

EXAMPLE 7

Two cigarettes were prepared and tested as described in Example 1, except that a solution containing 2.19 mg of the disodium salt of citric acid ($Na_2H$ citrate) in water was used.

EXAMPLE 8

A solution of Gantrez®, a copolymer of maleic anhydride and methyl vinyl ether available from GAF was prepared by dissolving 30 grams of Gantrez® in 125 ml of vigorously stirred boiling water. Upon cooling, 6 μl of this solution, containing approximately 1.2 mg of Gantrez®, was applied as 5 mm wide band around the middle of a 85 mm standard filter cigarette. Three cigarettes prepared according to this example were tested as described in Example 1.

EXAMPLE 9

Two cigarettes were prepared according to Example 8, except that 2.5 μl of the solution was applied.

EXAMPLE 10

Two cigarettes were prepared according to Example 8, except that 8 μl of the solution was applied as a 7 mm band.

EXAMPLE 11

Two cigarettes were prepared according to Example 8, except that a saturated solution of Gantrez dissolved in acetone was prepared. 10 μl of the solution was applied.

EXAMPLE 12

A solution of General Electric SF-96 Silicone Fluid was prepared by dissolving 3 grams of the fluid in 10 ml of chloroform and 6 μl of the solution was applied to two cigarettes as described in Example 1.

EXAMPLE 13

Two cigarettes were prepared according to Example 12 except that the solution contained 1.5 grams of General Electric SF-96 Silicone fluid in 10 ml of chloroform. 6 μl of the solution was applied.

EXAMPLE 14

Two cigarettes were prepared according to Example 12 except that the solution contained 1.0 grams of General Electric SF-96 Silicone fluid in 10 ml of chloroform. 6 μl of the solution was applied.

EXAMPLE 15

Two cigarettes were prepared according to Example 12 except 3 grams of Dow Corning 200 Silicone fluid was dissolved in 10 ml chloroform. 6 μl of the solution was applied.

EXAMPLE 16

Two cigarettes were prepared according to Example 15 except that the solution contained 1.5 grams of Dow Corning 200 Silicone fluid in 10 ml of chloroform. 6 μl of the solution was applied.

EXAMPLE 17

Two cigarettes were prepared according to Example 16 except 1.0 grams of Dow Corning 200 was used.

EXAMPLE 18

4 μl of Acrysol ASE-60 (Rohm and Haas) emulsion containing polyacrylic acid polymer was applied to cigarettes as a 5 mm band directly to two standard 85 mm cigarettes as described in Example 1. One cigarette was tested as described in Example 1.

EXAMPLE 19

3 grams of Acrysol ASE-60 were mixed in 10 ml of water and 6 μl were applied to three cigarettes as described in Example 1. The three cigarettes were tested as described in Example 1.

EXAMPLE 20

3 grams of galacturonic acid were dissolved in 10 ml total volume ammonium hydroxide (28%) 10 μl of the solution was applied to three cigarettes as described in Example 1.

When cigarettes having a reduced free burn time from Examples 1–20 are smoked on a smoking machine without interrupting the puffing regime, the cigarettes burn through the band and continued to burn normally with very little increase in burn time. Each of the materials used to form bands in accordance with Examples 1–20 is believed, on the basis of available information, to have no significant toxic effect if used as illustrated. Where banding materials are used which are not generally recognized to have no significant toxic effect, it is obvious that appropriate tests may be required.

The following Examples 21–23 show how cigarettes having a reduced free burn time can be manufactured on a production scale.

EXAMPLE 21

A solution containing 325 grams of malic acid dissolved in 500 ml of ethanol was prepared and placed in the reservoir of a rotating felt printing wheel on a modified cigarette manufacturing machine. A set of groove rollers picked up the cigarettes from a 4000 cigarette tray hopper and conveyed them to the rotating felt printing wheel which printed a 9 mm band in the middle of each cigarette. Each band contained about 2.0 to 3.0 mg of malic acid. A total of 900 cigarettes were printed in about 2 minutes.

EXAMPLE 22

An aqueous solution containing lactic, malic and citric acid in a 3:2:1 ratio by weight and about 10% acetone was prepared and used in the reservoir of a gravure type roller with indentations, equipped with a doctor blade to scrape off excess solution and an offset roller. The gravure printing head was attached to an AMF-190 cigarette maker equipped with gears designed to synchronize the printer with the cigarette cutter head to ensure that a 7 mm band would always be printed in about the center of the finished cigarette.

EXAMPLE 23

A mixture containing nine parts citric acid, lactic acid and malic acid combined in a ratio of 1:1.33:1.33; eight parts ink ($TiO_2$, linseed oil base) and one part acetone was used in a Molins Double Printer installed on a Molins Mark IX cigarette maker, run at a low machine speed setting of about 1330 cigarettes per minute. The band, containing about 2 mg of the citric/lactic/malic mixture was printed on the inside of the cigarette paper about halfway down the cigarette column.

The amount of material applied to the cigarette using this method can be varied by adjusting the pressure in the reservoir holding tank, the quantity of acetone used or the acid to ink ratio.

| Example | Treatment | Amount (mg) Band Width (mm) | Paper Side | Solvent | Typical Extinguishing Time (min:sec)* |
|---|---|---|---|---|---|
| 1 | Malic acid | 1.53/7 | outside | water | 2:58 |
| 2 | Malic acid | 1.68/7 | outside | ethanol | 3:58 |
| 3 | Malic acid | 1.68/7 | inside | water | 2:15 |
| 4 | Malic acid | 1.42/3 | outside | water | 3:29 |
| 5 | Citric acid | 1.51/7 | outside | water | 2:30 |
| 6 | $NaH_2$ citrate | 1.99/7 | outside | water | 3:25 |
| 7 | $Na_2H$ citrate | 2.17/7 | outside | water | 3:57 |
| 8 | Gantrez ® | 1.2/5 | outside | water | 1:55 |

-continued

| Example | Treatment | Amount (mg) Band Width (mm) | Paper Side | Solvent | Typical Extinguishing Time (min:sec)* |
|---|---|---|---|---|---|
| 9 | Gantrez ® | 0.5/5 | outside | water | failed to extinguish cig. |
| 10 | Gantrez ® | 1.6/7 | outside | water | 1:40 |
| 11 | Gantrez ® | 0.9/5 | outside | acetone | 2:40 |
| 12 | General Electric SF-96 Silicone Fluid | 1.64/7 | outside | $CHCl_3$ | 2:10 |
| 13 | General Electric SF-96 Silicone Fluid | 0.85/7 | outside | $CHCl_3$ | 2:30 |
| 14 | General Electric SF-96 Silicone Fluid | 0.53/7 | outside | $CHCl_3$ | failed to extinguish cig. |
| 15 | Dow Corning 200 Silicone Fluid | 1.64/7 | outside | $CHCl_3$ | 1:32 |
| 16 | Dow Corning 200 Silicone Fluid | 0.85/7 | outside | $CHCl_3$ | 3:12 |
| 17 | Dow Corning 200 Silicone Fluid | 0.63/7 | outside | $CHCl_3$ | failed to extinguish cig. |
| 18 | Acrysol-60 | 4.0/5 | outside | neat liquid | 1:55 |
| 19 | Acrysol-60 | 1.8/7 | outside | water | 3:00 |
| 20 | Galacturonic acid | 3.0/5 | outside | water | 3:36 |

*Measured from the time when the burning cone reached the band.

We claim:

1. In a smoking article having a reduced free burn time comprising tobacco wrapped in paper having at least one circumferential band printed between the ends of the smoking article, the band containing a substance which will cause the smoking article to extinguish if it is not puffed, the improvement which comprises an air permeable band about 2–10 mm wide which will not interfere with smoking if the article is puffed normally, said band containing a substance which is a liquid in the temperature range of about 100° C. to 200° C. and which, as the burning cone comes in contact with it, provides a fluid film on the paper, without substantially penetrating into the paper, which film once formed substantially restricts the flow of air to the burning cone and distills and/or decomposes endothermically from about 140° C. to 300° C. to yield gaseous decomposition products normally present in the smoke of smoking articles not having the band, the amount of said substance being effective to extinguish the smoking article within 2–5 minutes, under free burn conditions, after the cone reaches the banded area.

2. The improvement described in claim 1 wherein the substance in the band is selected from the group consisting of lactic acid; galacturonic acid; ammonium salts of galacturonic acid; polybasic organic acid having about 3–6 carbon atoms; the partial alkali metal, ammonium and alkaline earth metal salts of polybasic organic acids having about 3–6 carbon atoms; polybasic hydroxy organic acids having about 3–6 carbon atoms; the partial alkali metal, ammonium and alkaline earth metal salts of polybasic hydroxy organic acid having about 3–6 carbon atoms; acrylic acid polymers; polyvinylacetate, cellulose acetate; silicone polymers having the general formula:

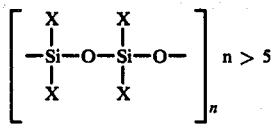

$$\left[ -\overset{X}{\underset{X}{Si}}-O-\overset{X}{\underset{X}{Si}}-O- \right]_n \quad n > 5$$

wherein X can be hydrogen, or an alkyl group having 1–6 carbon atoms or a substituted aromatic group and copolymers of maleic anhydride and vinyl radicals having the formula

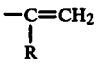

$$-\underset{R}{C}=CH_2$$

wherein R is hydrogen, alkyl groups having 1–6 carbon atoms, or an aromatic or substituted aromatic group.

3. The improvement as described in claim 2 wherein a mixture of two or more of the substances described in claim 2 are applied to the paper.

4. The improvement described in claim 1 wherein the band is about 3–7 mm.

5. The improvement described in claim 1 wherein a plurality of evenly spaced bands are used.

6. The improvement described in claim 1 wherein about 0.8 to 5 mg of the substance is in the band.

7. The improvement described in claim 1 wherein at least one band is applied to the inside of the paper.

8. The improvement described in claim 1 wherein at least one band is applied to the outside of the paper.

9. The improvement as described in claim 1 wherein about 0.85 mg to 2.5 mg of a substance selected from the group consisting of $NaH_2$ citrate, $Na_2H$ citrate, malic acid, citric acid, polyacrylic acid polymer, and a silicone polymer having the general formula:

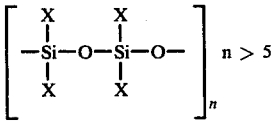

wherein X can be hydrogen, or an alkyl group having 1–6 carbon atoms or a substituted aromatic group is applied to the paper as a band about 7 mm in width.

10. The improvement as described in claim 1 wherein about 0.9 mg to 4.0 mg of a substance selected from the group consisting of a copolymer of maleic anhydride and methyl vinyl ester, polyacrylic acid polymer and galacturonic acid is applied to the paper as a band about 5 mm in width.

11. The improvement described in claim 1 wherein about 1.4 mg of malic acid is applied to the paper as a band about 3 mm in width.

12. A method of treating the paper of cigarettes and other smoking articles in order to reduce the free burn time comprising (a) mixing a substance which is a liquid in the temperature range of about 100° C. to 200° C. and which when a burning cigarette cone comes in contact with it forms a fluid film on the paper without substantially penetrating into the paper, which film one formed substantially restricts the flow of air to the burning cone and distills and/or decomposes endothermically from about 140° C. to 300° C. to yield gaseous decomposition products normally present in the smoke of untreated cigarettes; and (b) applying the solution from step (a) to a cigarette paper at about the center of the cigarette in the form of air permeable band about 2–10 mm wide which will not interfere with smoking if the article is puffed normally in an amount sufficient to extinguish the cigarette within 2–5 minutes, under free burn conditions, after the cone reaches the banded area but which will not extinguish the cigarette if it is puffed on when the burning cone meets the band.

13. A method as described in claim 12 wherein the band is about 2–7 mm wide and wherein the substance used in step a is selected from the group consisting of lactic acid; galacturonic acid; ammonium salts of galacturonic acid; polybasic organic acid having about 3–6 carbon atoms; the partial alkali metal, ammonium and alkaline earth metal salts of polybasic organic acids having about 3–6 carbon atoms; polybasic hydroxy organic acids having about 3–6 carbon atoms; the partial alkaline metal, ammonium and alkaline earth metal salts of polybasic hydroxy organic acid having 3–6 carbon atoms; polyvinylacetate; cellulose acetate; silicone polymers; acrylic acid polymers and copolymers of maleic anhydride and vinyl radicals having the formula

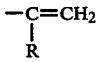

wherein R is hydrogen, an alkyl group having 1–6 carbon atoms, or an aromatic or substituted aromatic group.

* * * * *